United States Patent [19]

Naslund et al.

[11] 4,104,828

[45] Aug. 8, 1978

[54] SOLID DOOR HAVING EDGES OF LAMINATED PRESSED WOOD FIBER SHEET MATERIAL

[75] Inventors: Edwin N. Naslund; Ian MacDonald, both of Santa Rosa, Calif.

[73] Assignee: Cal-Wood Door, Santa Rosa, Calif.

[21] Appl. No.: 800,785

[22] Filed: May 26, 1977

[51] Int. Cl.[2] ..... E04B 1/94; B27K 3/18

[52] U.S. Cl. ..... 49/399; 49/504; 52/809; 428/45; 428/921

[58] Field of Search ..... 52/615; 428/920, 921, 428/45, 119, 120; 49/504, 503, 399

[56] References Cited

U.S. PATENT DOCUMENTS

| | | | |
|---|---|---|---|
| 3,196,494 | 7/1965 | Hartman | 52/615 |
| 3,254,592 | 6/1966 | Chase | 52/615 |
| 3,894,357 | 7/1975 | Stanfield | 52/615 |
| 3,940,516 | 2/1976 | Gierek | 428/921 |

FOREIGN PATENT DOCUMENTS

| | | | |
|---|---|---|---|
| 1,509,126 | 12/1967 | France | 52/615 |

*Primary Examiner*—John E. Murtagh
*Attorney, Agent, or Firm*—Limbach, Limbach & Sutton

[57] ABSTRACT

A solid board, specially adapted for use as a door with a long fire rating, comprising a fire resistant core material with edges thereon formed of a plurality of layers of sheet material of pressed wood fibers with a fire retardant added thereto. A fire door so constructed combines the advantages of a high fire rating and thick wooden edges for securely holding door mounting hardware.

10 Claims, 3 Drawing Figures

SOLID DOOR HAVING EDGES OF LAMINATED PRESSED WOOD FIBER SHEET MATERIAL

BACKGROUND OF THE INVENTION

This invention relates to the construction of a solid board, such as a door, and more specifically to a fire rated door formed of a solid core and wooden strips attached around its edges.

Typical present solid door construction include three basic components: a core, wood edges attached around the core (the vertical edges being referred to as stiles and the horizontal edges as rails), and thin facing material covering both sides of the door for its appearance. A principal factor taken into account in choosing the materials for the core and the wooden edges, and also for determining the thickness of the wooden edges, is the fire rating desired for the door. Building codes require that doors to be installed in certain building positions need to have a particular fire rating that is measured in time, such as a 20 minute door, or a 45 minute, one-hour or one and one-half hour door. Doors are given a fire rating in accordance with a standard test specification. A leading test is ASTM E-152 (1976). Others are UL 10(b) (1974), NFPA 252 (1972) and UBC 43-2 (1973), all similar to the ASTM test. In conducting such tests, doors are mounted in an opening of a fireproof wall and then exposed on one side to a predetermined time-temperature rise function. The time that a door can withstand the heat before it is penetrated by burning determines its fire rating.

Fire door core materials commonly used at the present time include untreated wood or particle board for doors of a low fire rating, such as 20 minutes, or a particle board treated with a fire retardant, or a mineral core for doors of the higher fire rating, such as 45 minutes or more. A one-hour rated mineral door core is presently commercially available from the Gypsum Division of the Georgia-Pacific Corporation.

Wood stiles and rails (edges) are attached to the core edges by an appropriate adhesive, usually by the door manufacturer, in order to provide edges that will hold wood screws used by the purchaser of the door to mount normal hardware thereon, such as hinges and door latching mechanisms. Presently available doors utilize solid wood stiles and rails that have been treated with a fire retardant, often in a salt form. Hemlock and maple are popularly utilized wood species for door stiles and rails. As the desired fire rating of the door goes up to 45 minutes or more, the stiles and rails must be made very narrow. The reason for this is that such fire retardant treated solid wood material cannot withstand the heat of a standard fire test for such long periods of time without being penetrated by burning. Therefore, the stiles and top rail are made to be as narrow as the door stop on a frame on which the door is to be mounted during the fire test. The standard fire tests identified above test for fire penetration during the test period of only the door portion between door stops. That is, penetration of the door edges behind the door stops does not disqualify the door; it passes the test anyway because no penetration is visible. The door core is made to overlap the door stops. Typical dimensions for such a long fire rated door are stiles of $\frac{3}{4}$ inch wide, a top rail of $\frac{5}{8}$ inch wide and a bottom rail of 1-$\frac{1}{4}$ inch wide.

Such a narrow stile, necessitated by the desired fire rating of the door, has low resistance to splitting along its grain and a low ability to hold wood screws. The core material provides no screw holding power. Commercially available doors of all types are listed in manufacturers' product catalogs accumulated in "Sweet's Catalog File: Architectural Products for General Building", Volume 5, Section 8.3 (1977), published by the McGraw-Hill Information Systems Company and widely used by architects.

It is a principal object of the present invention to provide an improved solid board, such as a door, having a high fire rating but, with more substantial wooden edges for better resisting wood screw withdrawal and splitting than present doors of an equivalent fire rating.

SUMMARY OF THE INVENTION

This and additional objects are accomplished by the present invention, briefly summarized, wherein the door edges, particularly the stiles, are made of laminated strips of solid pressed wood fibrous sheet material having a fire retardant additive therein. The stiles are installed in the door with the surfaces between the laminated sheets of material held parallel to its core edge surfaces in order to maximize screw holding ability and split resistance. The laminations of the rails, on the other hand, may be oriented either parallel or perpendicular to the core edge depending on the direction of screw attachments.

The principal advantage of such door construction is that for a given door core material, the stiles and rails (edges) may be made thicker than existing solid wood edges so that hardware may be more securely attached, even after allowing for some trimming of the edge thickness on the site by the person installing the door, all while maintining a high fire rating of the overall door construction of 45 minutes or more. Sheet material of the type utilized for the edges of the improved door construction is commercially available, its intended purpose being to prevent flame spread along the surface of the material when installed as wall paneling in buildings and mobile homes. But it has been found that such material has improved fire penetration characteristics as well and is advantageously utilized for fire door edges. Although there is presently considerable development effort going into improving fire door cores, no attention has been directed toward improving the wood door edges because, it is believed, that presently used fire retardant salt treated solid wood edges is all that can be done with the prospect of any significant improvement not existing.

It has also been found that the screw holding power of the improved door edges is extremely good relative to that of the fire retardant salt treated solid wood, even though the holding power of a single sheet of such pressed wood material is inferior. Salt treated wood has a further disadvantage of having density variations which make its screw holding ability and salt fire retardant content vary throughout the wood. Thus, door hardware is securely attached to uniform density door edges made of the material according to the present invention.

Additional objects, advantages and features of the present invention are described with respect to a preferred fire door construction embodiment thereof, which description should be taken in conjunction with the accompanying drawings.

DESCRIPTION OF A PREFERRED EMBODIMENT

Figure 1:
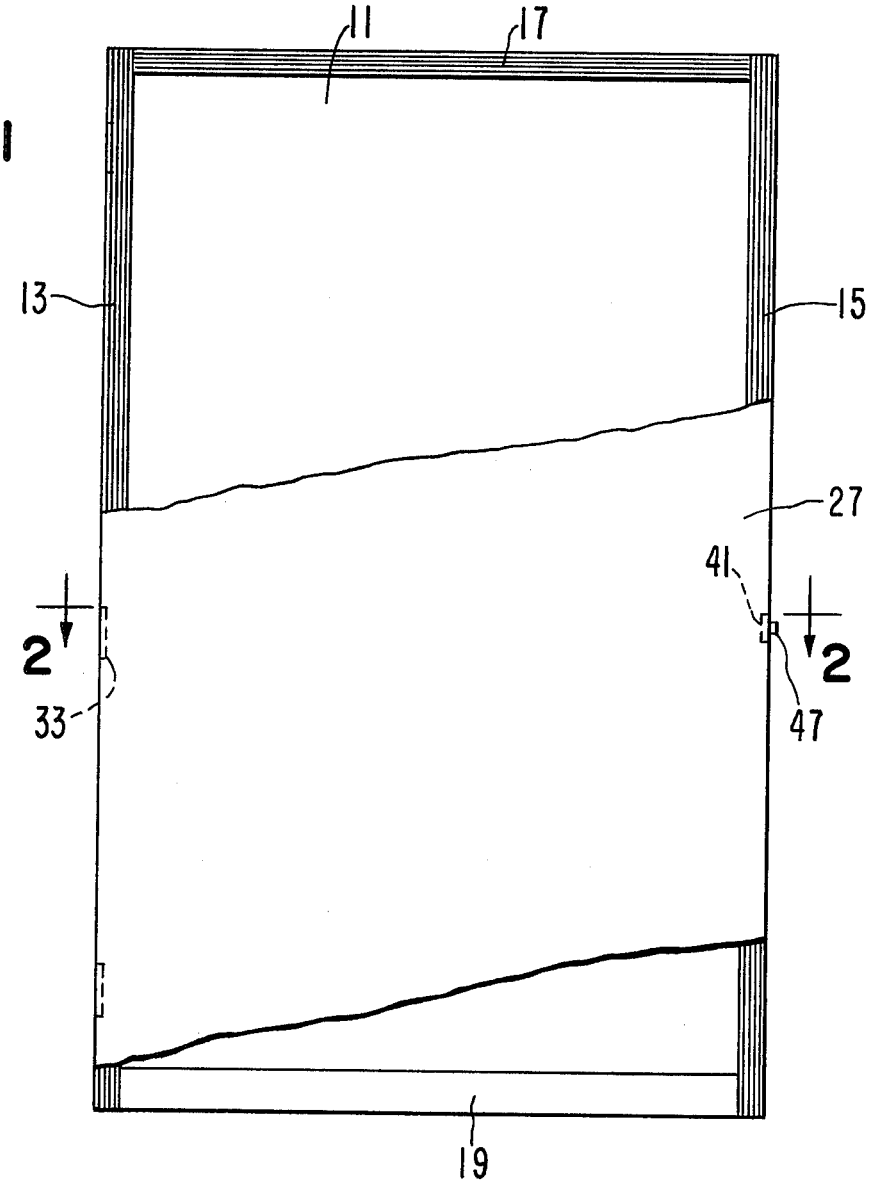
FIG. 1 shows a door, its facing partially cut away, having a construction according to the present invention.
Figure 2:
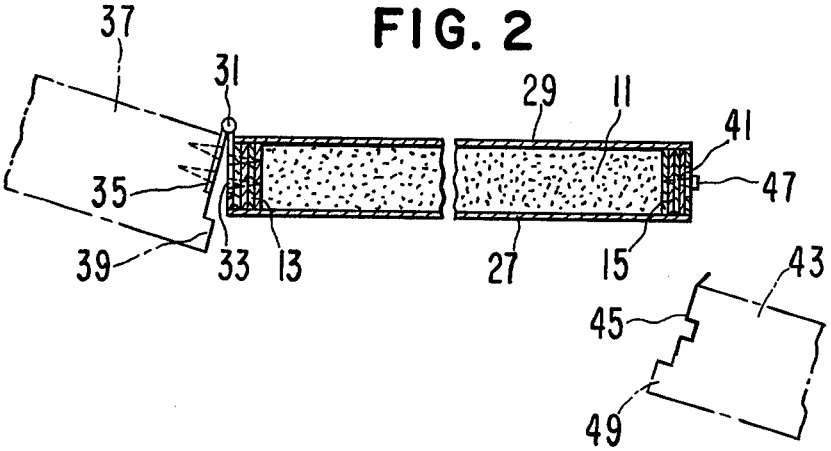
FIG. 2 is a cross-sectional view of the door of FIG. 1, taken at section 2—2 thereof.

A preferred structure having maximum advantage that utilizes the various aspects of the present invention is a fire door such as illustrated in FIGS. 1 and 2. Such a fire door comprises three main components. Most of the door is formed of a core material 11 in a rectangular shape, the first component. Of course, for unusual shaped doors, the core material 11 would take on some other shape. The core 11 is usually of a uniform thickness, although it does not have to be for special effects, and has its major opposing surface areas terminate in edges which are themselves planar and perpendicular to the major surface planes of the core 11.

The core 11 may be one continuous, homogeneous piece throughout, or it may consist of a plurality of pieces, usually around one foot or so square, arranged to fill the entire core area within the door. A preferred core material for a high fire rating door is a preformed homogeneous mineral slab made up of a combination of fiber glass, gypsum, calcium silicate and other fire resistive materials. Such a door is one manufactured by the Georgia-Pacific Company and referenced herein before. Alternatively, the core may be formd of a combination of wood particles, fire resistive or retardant additives, and adhesive, preformed into slabs. Mineral cores or fire treated particle board are generally used for the higher fire rating doors, such as 45 minute and one-hour doors, while untreated wood product cores are generally used for fire doors of lesser ratings, such as those having a 20 minute fire rating. Of course, other core materials are suitable so long as they are solid and have equivalent fire resistive characteristics.

The second main door component is its edges. Wood edges are attached by an appropriate adhesive to the four edges of the core 11 in the form of stiles 13 and 15, top rail 17 and bottom rail 19. Solid wood edges are generally used in existing doors to permit trimming the sides of the door on the construction site during the installation of the door and also to provide a material for holding door hardware by means of screws. But the material utilized in the door of FIGS. 1 and 2 is different than that of the present solid wood, fire retardant impregnated door edges. The stiles 13 and 15 and the top rail 17 are preferably constructed, according to an improvement of the present invention, of a plurality of laminated sheets of uniformly thick pressed wood fiber material having a non-salt fire retardant added thereto during its manufacture.

Wood fiber sheets are formed, as is generally known, by subjecting wood chips to either pressurized steam or a chemical bath to break the wood down into its individual fibers in the form of a wet slurry. This wet slurry is then reformed by spreading onto an open screened surface mat where it is subjected to pressure and heat. A natural chemical component of wood then flows to hold the wood fibers together in its new form. A fire retardant material is conveniently added during the manufacturing process while the fibers are still in a wet slurry in a manner to result in the material being dispersed throughout the resulting wood product substantially uniformly. The fire retardant material may alternately be impregated into the individual fibers themselves. An aluminum compound, such as alumina, aluminum hydroxide or aluminum silicate is a common fire retardant. Boron compounds are also known fire retardants and can be utilized.

A commercially available wood fiber board that is satisfactory for this application is one sold under a "Flame Test" panel brand by the Masonite Corporation. This material is obtained in wall panel sheets of typical thickness of 0.245 inch, with a specific gravity typically of 1.10, and includes an aluminum compound as a fire retardant in the proportion of approximately 35% of its weight. Although this material is designed to prevent flame spread along the surface of wood paneling in order to meet new mobile home fire retardant code standards, it has also been found to be a good material to prevent fire penetration.

Figure 3:
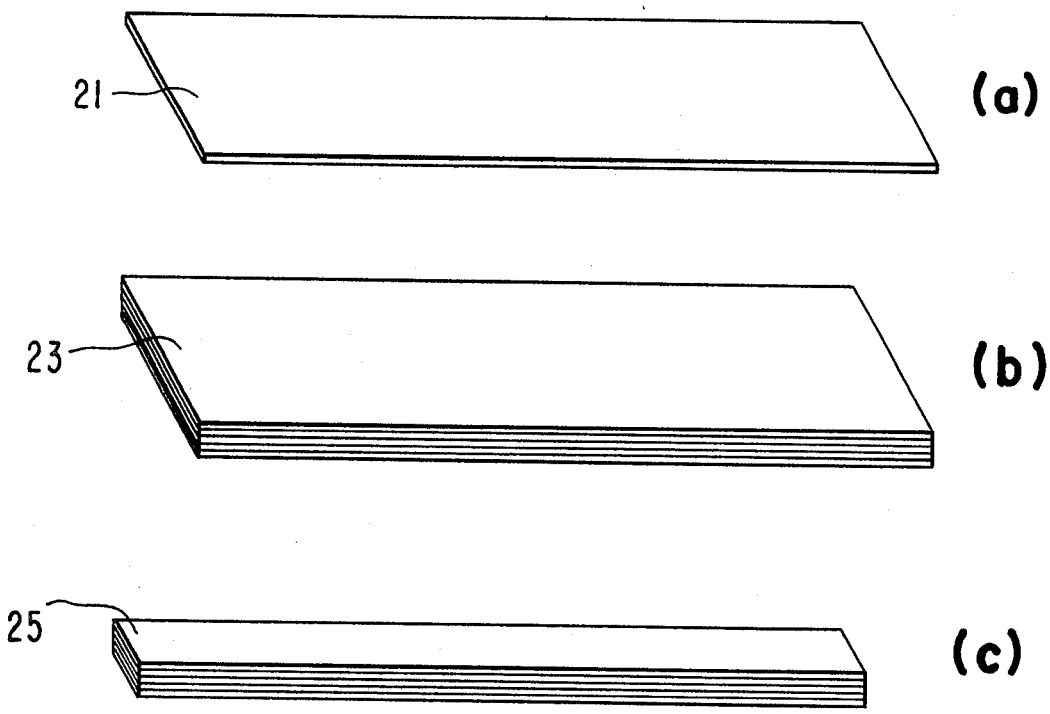
FIG. 3 illustrates the steps of manufacturing the edges of the door of FIGS. 1 and 2.

The stiles 13 and 15 and top rail 17 are preferably made with such commercially available material in a manner illustrated in FIG. 3. A number of sheets of the wood pressed fiber material, such as the sheet 21, are glued together to form a composite structure 23. Each of the sheets is of substantially a uniform thickness, is flat and is of a uniform density. They are sanded or planned on each side to provide smooth surfaces to receive adhesive. Up to seven layers of nominally ¼ inch thick sheet material are glued together depending upon how wide the door edges are to be, five sheets being illustrated herein for a typical fire door application. The edges 13, 15 and 17 of FIG. 1 are thus approximately 1¼ inch wide. This is in excess of the width of the typical door jamb stop for which the door is designed to be used.

In forming the composite pressed wood material 23, every other layer receives an application of wet glue on each side. The alternate pieces are dry. The layers are then built up by alternately laying down dry and wet glued pieces until the desired number of layers are in the uncured board. The combination is then subjected in a press to pressure for a time until the glue is cured. After the adhesive cure becomes complete, the individual cured laminated boards 23 (FIG. 3), are cut into narrow strips, such as the strip 25, for installation as a stile or rail (edge) as part of a finished door.

The edge material 25 (FIG. 3) is installed on the edge of the core 11 of the door of the type illustrated in FIG. 1 in a manner that the glued together surfaces are parallel to the edge surface of the core 11 to which it is attached by an appropriate adhesive. This orientation provides the maximum screw holding surface at the edge of the finished door. The fire retardant capabilities of the wood edges made according to this technique depends upon the thickness of the edge, usually the same as the uniform thickness of the core material 11, and the amount of and type of fire retardant that has been added to the pressed fiberboard during its manufacture. A door is given a fire rating according to standard tests by watching how long it takes for the fire on one side of the door to penetrate in the form of holes either at the core or around the edge material. A 45 minute or one-hour rating according to such tests has been obtained with the aforementioned Masonite material that is formed of five layers in width and a thickness of 1-½ inches to match the mineral core thickness. The use of aluminum compound as a fire retardant in an amount in excess of about 30% of the weight of pressed fibrous material having an overall specific gravity of about 1.10 appears to be satisfactory for such doors.

The bottom rail 19 may be of the same laminated material but it is not as critical since the bottom of a door does not receive the same intense heat either in the fire tests or in an actual fire as does the top rail 17 or the upper portions of the stiles 13 and 15. If the laminated sheet pressed wood fiber material is not utilized for the bottom rail 19, a standard solid wood with a fire retardant impregnated therein is utilized.

The third major component of the door being described is a facing material illustrated as face sheets 27 and 29. These sheets are attached to the core 11 and the continuous surface thereof formed by the edges 13, 15, 17 and 19 by an adhesive under pressure. The face sheets 27 and 29 are typically only ⅛ inch thick to form a composite door having an overall thickness of 1¾ inch when used with typical edge and core thicknesses of 1½ inch. The facing sheets 27 and 29 provide an overall covering of the door faces principally for good aesthetics.

Pressed fiberboard characteristically resists splitting because it does not have a grain; rather, the wood fibers are oriented in a random manner rather than being aligned to form a grain as is the case in natural solid wood. But since the fiberboard can be made to have a density greater than that of wood, there is the advantage, if the specific gravity of fiberboard is in excess of 0.80, that the laminated formed door edges have a screw holding power significantly in excess of that of ordinary solid wood that is presently being used for door edges.

Referring to FIG. 2, a full mortise hinge 31 is schematically illustrated having one leaf 33 attached to a door edge according to the present invention with screws shown in dotted outline in accordance with normal techniques. A second leaf 35 of the hinge 31 is attached by screws shown in dotted outline to a door jamb that is part of a wall 37, the door jamb including a door stop 39 as well. The stile 15 is also shown schematically with a standard lock front 41 (part of a full lock set, the remaining elements not being shown), held to the stile 15 by a screw shown in dotted outline. A wall 43 includes a strike plate 45 attached to the door jamb for accepting a lock bolt 47. The door jamb on the wall 43 also has a door stop 49. Because the stiles 13 and 15 can be made thicker with the improved construction of the present invention than are stiles of presently available fire doors of long fire rating, there is plenty of edge wood to hold adequately sized wood screws along with the hardware attached to the door, even after the door is trimmed somewhat and the hardware mortised (recessed) into the wood edge according to common practice. Other hardware may be attached as desired.

The reason why the stiles and top rail of present doors are of a long fire rating, such as 45 minute or one-hour doors, are made so thin, generally ¾ inch or less, can be seen from FIG. 2. In order to pass the standard fire rating tests conducted with a door hung in a typical manner, the wood edges, because they cannot resist penetration by the heat and fire for the rated length of time, must be hidden behind the door stops 39 and 49. That is, the core material 11 that has the required fire rating is caused to overlap the door stops by making the wood edges extremely thin. The door constructed according to the present invention, on the other hand, need not rely upon the door stops for fire retardant properties, and thus the core material 11 does not need to extend so far as to overlap the door jambs. The thicker stiles and rails permit more material for secure wood screw holding and gives greater flexibility to those installing the doors by having excess material which may be removed from the edge for exact on-site fitting of the door to a particular application.

Although the various aspects of the present invention have been described with respect to a particular fire door construction as a preferred embodiment, it will be understood that the invention is entitled to protection within the full scope of the appended claims.

We claim:

1. A fire door, comprising:

a rectangularly shaped piece of core sheet material having a substantially uniform thickness and edges on all four sides thereof that are planar and perpendicular to major planar surfaces of said core, wood strips attached to at least the opposing edges of said core that are of the longest length, the thickness of said strips being substantially the same as the thickness of the core material, said strip being formed of a plurality of layers of sheet material of uniform thickness that are adhered to one another and to the edge of the core material in a manner that the surfaces of the sheet material are oriented parallel to the edge surface of the core to which it is attached, said sheet material being formed from a slurry mixture of individual wood fibers and a fire retardant chemical through the use of heat and pressure, and facing sheet material attached to the major surfaces of said core material as extended by said wood strips, thereby to form continuous aesthetically pleasing surfaces on either side.

2. The fire door according to claim 1, and additionally comprising at least one hinge attached in a mortise to one of said wood strips by the use of screws and a lock set lock front attached in a mortise by screws to the other of said at least two wood strips.

3. The fire door according to claim 1, wherein the thickness of the core material and its composition, and the thickness of each of the top rail and wood stiles and the amount of fire retardant material therein are selected to have a fire rating of 45 minutes or more.

4. The fire door according to claim 1 mounted with one of said longest length wood strip edges being hingedly attached to a door jamb, said jamb including a door stop positioned to be held against at least one of said longest length edges when the door is closed, said door stop having a thickness that is significantly thinner than the thickness of said at least one of its longest length edges taken in a direction away from its core edge.

5. The fire door according to any of claims 1, 2, 3 or 4 wherein said fire retardant comprises an aluminum compound that accounts for in excess of 30% of the weight of the finished sheet material.

6. The fire door according to any of claims 1, 2, 3 or 4 wherein said sheet material is additionally characterized by having a specific gravity in excess of 0.80.

7. A solid board, such as a door, comprising:

a sheet of core material having a substantially rectangular edge perimeter, a wood strip firmly attached to at least a portion of said core edge, said wood strip being formed of a plurality of layers of sheet material firmly adhered to one another with the adhering surfaces being oriented parallel to the edge surface to which the wood strip is attached, said sheet material being formed from a slurry mixture of individual wood fibers and a fire retardant chemical through the use of heat and pressure.

8. The solid board according to claim 7 wherein said fire retardant comprises an aluminum compound that accounts for in excess of 30% of the weight of the finished sheet material.

9. The solid board according to either claim 7 or 8, wherein said sheet material is additionally characterized by having a specific gravity in excess of 0.80.

10. The solid board according to either claim 7 or 8 wherein said core consists essentially of a solid mineral material.

* * * * *